US009630230B2

(12) United States Patent
Plau

(10) Patent No.: US 9,630,230 B2
(45) Date of Patent: Apr. 25, 2017

(54) DEVICE AND METHOD FOR FORMING BY STAMPING AT HIGH SPEED

(71) Applicant: ADM28 S.AR.L, Luxembourg (LU)

(72) Inventor: Eran Plau, Tzofit (IL)

(73) Assignee: ADM28 S.ÀR.L, Luxembourg (LU)

( * ) Notice: Subject to any disclaimer, the term of this patent is extended or adjusted under 35 U.S.C. 154(b) by 0 days.

(21) Appl. No.: 14/654,518

(22) PCT Filed: Dec. 18, 2013

(86) PCT No.: PCT/EP2013/077084
§ 371 (c)(1),
(2) Date: Jun. 20, 2015

(87) PCT Pub. No.: WO2014/095996
PCT Pub. Date: Jun. 26, 2014

(65) Prior Publication Data

US 2015/0343512 A1 Dec. 3, 2015

(30) Foreign Application Priority Data

Dec. 21, 2012 (FR) ..... 12 62673
May 16, 2013 (FR) ..... 13 54406

(51) Int. Cl.
*B21D 22/10* (2006.01)
*B21J 5/04* (2006.01)
(Continued)

(52) U.S. Cl.
CPC ..... *B21D 22/10* (2013.01); *B21C 37/294* (2013.01); *B21D 22/105* (2013.01); *B21D 26/14* (2013.01); *B21J 5/04* (2013.01); *B30B 1/42* (2013.01)

(58) Field of Classification Search
CPC ..... B21D 26/14; B21D 22/10; B21D 22/105; B21C 37/294; B21J 5/04; B30B 1/42
(Continued)

(56) References Cited

U.S. PATENT DOCUMENTS 3,279,228 A * 10/1966 Brower ..... B21D 26/14 29/421.1
3,670,545 A * 6/1972 Kent ..... B21C 37/294 29/890.148
(Continued)

FOREIGN PATENT DOCUMENTS

AU 78136 75 A 5/1975
DE 11 61 228 B 1/1964
(Continued)

*Primary Examiner* — David B Jones
(74) *Attorney, Agent, or Firm* — Im IP Law; C. Andrew Im

(57) ABSTRACT

A device and a method for forming by stamping a curved metal sheet. The device includes a punch made of deformable and substantially non-compressible material, a hammer configured to strike the punch along the longitudinal axis Z. A generator to generate a magnetic field configured to impart on the hammer a speed greater than a predetermined speed in the Z direction. The device further includes a matrix of predetermined shape, approximately rotationally symmetrical about the longitudinal axis Z. The punch is rotationally symmetrical about the longitudinal axis and configured to be disposed in front of the matrix. The punch has a longitudinal dimension in the same order of magnitude as its dimension perpendicular to the longitudinal axis Z.

9 Claims, 2 Drawing Sheets

(51) Int. Cl.

| | |
|---|---|
| ***B21C 37/29*** | (2006.01) |
| ***B21D 26/14*** | (2006.01) |
| ***B30B 1/42*** | (2006.01) |

(58) Field of Classification Search
USPC ..... 72/56
See application file for complete search history.

(56) References Cited

U.S. PATENT DOCUMENTS

| | | | | |
|---|---|---|---|---|
| 5,016,458 | A | 5/1991 | De Smet | |
| 5,269,213 | A | 12/1993 | Coneski et al. | |
| 7,076,981 | B2 * | 7/2006 | Bradley | B21D 26/14 29/419.2 |
| 7,954,357 | B2 | 6/2011 | Bradley et al. | |
| 8,056,279 | B2 * | 11/2011 | Carter | B23P 9/00 29/446 |

FOREIGN PATENT DOCUMENTS

| | | | |
|---|---|---|---|
| DE | 20 2010 013183 | U1 | 3/2011 |
| EP | 0 376 808 | A1 | 7/1990 |
| JP | S59 85329 | A | 5/1984 |
| JP | S61 56736 | A | 3/1986 |

* cited by examiner

DEVICE AND METHOD FOR FORMING BY STAMPING AT HIGH SPEED

RELATED APPLICATIONS

This application is a §371 application from PCT/EP2013/077084 filed Dec. 18, 2013, which claims priority from French Patent Application Nos. 12 62673 filed Dec. 21, 2012 and 13 54406 filed May 16, 2013, each of which is herein incorporated by reference in its entirety.

TECHNICAL FIELD OF THE INVENTION

The present invention relates to the field of forming materials.

It is aimed more particularly at a device and a method for forming metal parts by stamping.

BACKGROUND OF THE INVENTION

In leading industries (aeronautic, space and automotive sectors or other manufacturing industries), the required and necessary precision during the shaping of parts may be high and the techniques put in place to meet these requirements are becoming increasingly complex.

When a metal part is to be shaped, stamping is very often the chosen method, since this method is reliable and can be controlled very readily. Stamping consists in a plastic deformation of a plate of material, under the action of a pressure, so as to give the plate the shape of a predetermined mold. Even though the technique is generally used on metal materials (steel, aluminum, etc.), it can also be applied to numerous plastics materials such as PVC, polyethylene, polycarbonate, etc.

One of the variants for carrying out forming by stamping is the process known as elastoforming (Guerin process), the principle of which is to apply a stress to an elastomer (for example by means of a ram) which then performs the function of a punch or die. The elastomer transmits the pressure to which it is subjected to the plate to be deformed, the latter hugging the shape thereof during the stamping operation.

Patent application EP 0 376 808 (Isoform, 1988), which relates to a method and device for stamping sheet material with a punch which is deformable under the action of a plunger, is known in particular in this field.

However, one disadvantage of this method lies in the fact that it is only possible to carry out shallow stamping operations in lightweight metals of small thicknesses (for example: aluminum). In practice, the method is limited to a sheet metal thickness of 1.5 mm.

Another disadvantage of this shaping method is that of the elastic return which occurs after relaxation of the part to be formed. This effect is greater or lesser depending on the material in question and may prove to be problematic when it is no longer negligible when considering the expected precision.

U.S. Pat. No. 7,954,357, which discloses a method and device for stamping flat sheet material with a deformable punch of substantially flat shape, is also known.

SUMMARY OF THE INVENTION

The object of the present invention is, in particular to provide an effective solution for notably reducing elastic return and for applying the principle of elastoforming to metals such as steel or Inconel and/or those having a large thickness.

The invention is firstly aimed at a device for forming by stamping a curved metal sheet, said device comprising:

- a punch made of deformable and substantially non-compressible material,
- a hammer adapted to strike the punch along the longitudinal axis (Z).

The device comprises means for generating a magnetic field which are adapted to impart to the hammer a speed ($V_Z$) greater than a predetermined value in this direction (Z).

The device comprises a die of predetermined shape which is substantially rotationally symmetrical about a longitudinal axis (Z), and the punch is rotationally symmetrical about the longitudinal axis (Z) and adapted to be arranged facing the die such that it has a non-zero predetermined distance G between the metal sheet and the die.

Said non-zero predetermined distance G makes it possible to ensure that the metal sheet 14 can be set in movement. Specifically, said metal sheet 14 is advantageously positioned so as not to have any points of contact with the die 10, thus making it possible to obtain a high impact speed of the metal sheet 14. This high impact speed allows a dynamic deformation of the metal sheet 14, that is to say a high-speed deformation. This high-speed deformation allows more efficient forming and also a decrease in elastic return. In one particular embodiment, the punch has a longitudinal dimension (H) greater than or equal to, or of the same order of magnitude as, its radial dimension (R) perpendicular to the longitudinal axis.

In this way, said punch is deformed at least radially subsequently to being struck axially by the hammer, and is thus capable of forming a metal sheet arranged in particular on the periphery of said punch.

This is contrary to what occurs with the existing devices for forming by stamping, in which the punch is deformed axially subsequent to an axial impact of the hammer, and forms a metal sheet arranged only along the longitudinal end of said punch.

The means for generating a magnetic field communicate an acceleration to the punch of an intensity selected beforehand for a limited duration in order to generate a high striking speed.

It will be understood that the effect of this device is to allow the application, at high speed (permitted by the electromagnetic nature of the force created), of a pressure to the punch, so that it very rapidly deforms the metal sheet in correspondence with the shape of the die to which said sheet is applied.

The device advantageously comprises means for imparting to the hammer an axial speed ($V_Z$) greater than or equal to a minimum axial speed ($V_{z_min}$) for obtaining a plastic deformation of the metal sheet. The axial speed ($V_Z$) is greater than 20 m/s in one particular embodiment.

In one particular embodiment, the punch is made of non-compressible elastomer having a Poisson's ratio of close to 0.5.

Specifically, it has been observed surprisingly that when the elastomer is stressed by a hammer (the striking means) moving at high speed, the elastomer has a viscoelastic behavior which results, on the one hand, in more efficient forming (that is to say conforming more to the die) of the part, and, on the other hand, in a reduction of elastic return of the formed part.

A deformable and substantially non-compressible material is understood to mean a material of elastomer type which is adapted for use as an elastoforming pad. In another embodiment, the deformable and non-compressible material could be constituted by a liquid surrounded by a flexible envelope. Such materials are well known to those skilled in the art.

In one particular embodiment, the end wall of the die forms a stop for the front face of the punch.

The invention is aimed under a second aspect at a forming assembly comprising a forming device as explained, and a die of predetermined shape which is substantially rotationally symmetrical about a longitudinal axis (Z), characterized in that the distance G between the sheet and the die is non-zero.

Specifically, the radial striking speed $V_R$ of the punch/metal sheet assembly against the die is proportional to the cube of this distance G. When the radial speed is sufficient, the metal sheet has a plastic behavior and completely hugs the shape of the internal face of the die.

The invention is aimed under another aspect at a method for deformation by stamping of a curved metal sheet using an assembly as explained above, the method comprising the following steps:

- placing the metal sheet within the die,
- placing the punch inside the metal sheet,
- generating a magnetic field imparting to the hammer a speed ($V_Z$) greater than a predetermined value in this direction (Z),
- striking the hammer against the punch along the longitudinal axis (Z),
- radially deforming the punch at a radial impact speed $V_R$ sufficient to obtain a plastic deformation of the metal sheet.

Advantageously, the die is embodied so as to have a non-zero distance G between the metal sheet and the die.

BRIEF DESCRIPTION OF THE DRAWINGS

The features and advantages of the invention will be better appreciated by means of the description which follows, the description setting out the features of the invention by way of a non-limiting application example.

The description is based on the appended figures, in which.

DETAILED DESCRIPTION OF AN EMBODIMENT OF THE INVENTION

Figure 1A:
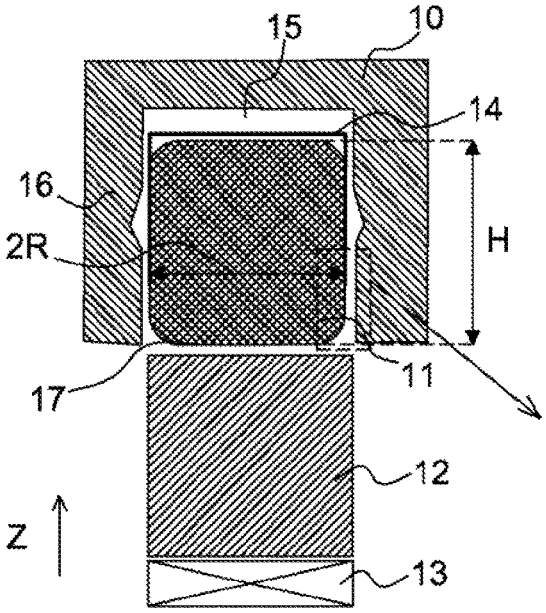
FIG. 1*a* Shows a schematic view of the elements involved in the elastoforming device used with a hollow die, before forming, according to a first embodiment.

It will be noted first of all that the figures are not to scale. In the remainder of the description, the term "metal sheet" is used to denote the part to be formed, but the invention is aimed more generally at a thin plate made of plastic, metal or other material. A plate is referred to as thin when one of its dimensions is significantly smaller than the other two, typically by at least one order of magnitude.

In one exemplary embodiment of the device, the latter is associated with a die 10. It further comprises an elastomer punch 11, a hammer 12 and a device 13 for generating a magnetic field (of which only the coil is depicted in the figures). This device is adapted to create a high-power magnetic field which can generate a strong acceleration in the hammer 12, with the result that it strikes the punch at high speed. Advantageously, the hammer 12 is independent of the device 13 for generating a magnetic field.

The die 10, the punch 11 and the hammer 12 are here assumed to be rotationally symmetrical about a longitudinal axis Z. The die 10 has substantially the shape of a hollow cylinder closed at its upper end by an end wall 15, and laterally comprises a groove 16, here of triangular cross section. The punch 11 is diagramatically represented by a cylindrical volume with a radius slightly smaller than that of the die 10. The hammer 12 here has a radius assumed to be globally identical to that of the punch 11, and bears on its lower face 17.

A metal sheet 14, here of cylindrical shape closed at its upper end, is inserted into the die 10, and receives the punch 11 in its internal volume. In other words, the shape of the metal sheet 14 does not correspond to a tubular shape. The deformation of the metal sheet of closed cylindrical shape is influenced by its closure at its upper end. It will be understood that, more generally, the metal sheet 14 placed within the die is curved with a simple curvature, the die being of concave shape with rotational symmetry about an axis Z, and the punch being of substantially complementary shape.

Figure 4:
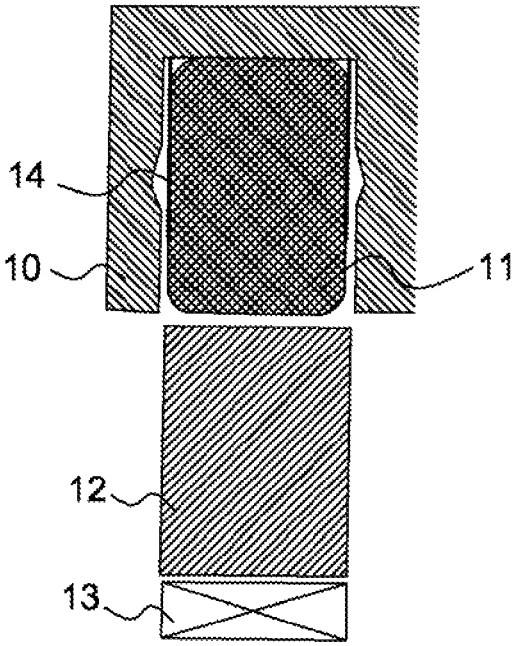
FIG. 4 shows a schematic view of the elements involved in the elastoforming device used with a hollow die, before forming, according to another embodiment.
Figure 5:
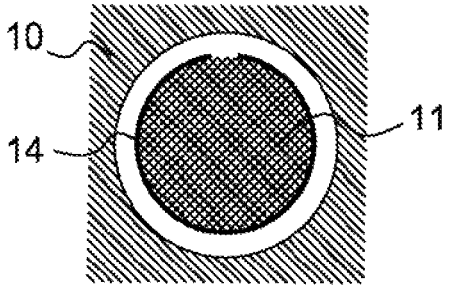
FIG. 5 shows a plan view in section of these same elements.

The metal sheet 14 is represented in FIG. 1*a* as hugging the shape of the end of the punch 11. In one variant embodiment, the metal sheet is of closed cylindrical shape, and hugs only the lateral part of the punch 11. In another variant, illustrated in FIG. 4, the metal sheet 14 is of cylindrical shape open at its upper end. In another variant, illustrated in FIG. 5, the metal sheet 14 is of open cylindrical shape and hugs only part of the lateral surface of the punch 11.

Figure 1B:
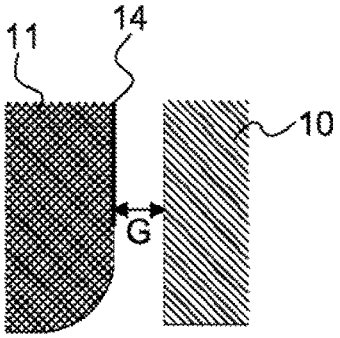
FIG. 1*b* shows an enlarged view of a detail of FIG. 1*a;*
Figure 2:
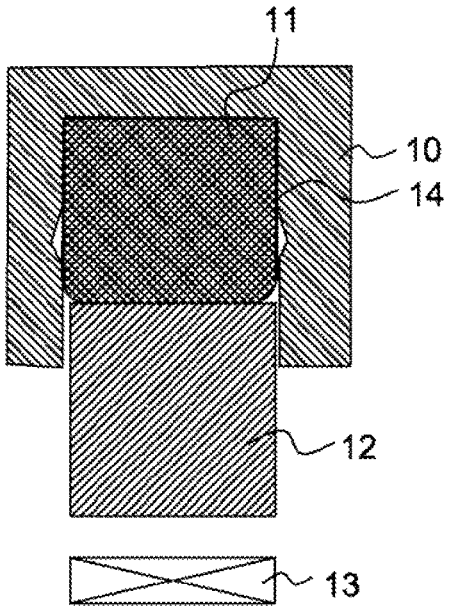
FIG. 2 shows a view of these same elements, in the course of forming.
Figure 3:
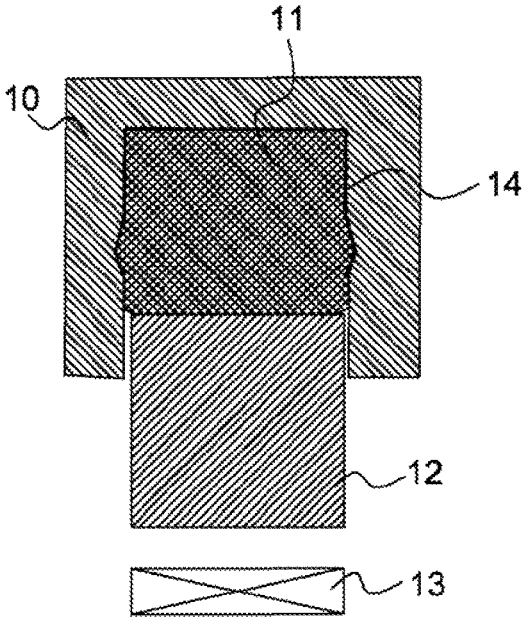
FIG. 3 shows a view of these same elements, after forming.

It should be noted that in the present exemplary embodiment, the punch 11 is in contact with the metal sheet 14 over the major part of a face of the latter, before the forming device is put into operation. The metal sheet 14 is spaced from the die 10 by a non-zero distance G (illustrated in FIG. 1*b*).

In a less advantageous embodiment variant (not shown), the metal sheet 14 is in contact with the die 10 before putting the forming device into operation and is spaced from the punch 11 by a non-zero distance.

The punch 11 is assumed to be made here of a non-compressible elastomer (Poisson's ratio of close to 0.5), that is to say that its deformation occurs at a constant volume. Moreover, it is assumed that the metal sheet 14 is sufficiently thin so as to have no influence on the deformation of the punch 11.

In the present exemplary embodiment, and as can be seen in FIG. 1*a*, the end wall 15 of the die 10 forms a stop for the front face of the punch 11. What is meant by that is that this end wall 15 does not have a through-opening.

The hammer 12 is one in which the material and characteristics are known to those skilled in the art and are therefore not described in more detail here.

Mode of Operation

The coil of the device 13 for generating a magnetic field generates a magnetic field which moves the hammer 12 toward the elastomer punch 11. The punch 11 will therefore be compressed axially and, by virtue of its non-compressibility and the end wall 15 of the die, will then be constrained to deform radially and uniformly, thereby allowing forming of the metal sheet 14 placed between the punch 11 and the die 10.

In one non-limiting exemplary embodiment, the metal sheet 14 to be formed takes the form of a 15-5PH steel cylinder with a diameter of 38 mm. The punch 11 is a cylinder made of elastomer (90 Shore A polyurethane) with a radius R=19 mm and a height H=15 mm. The mold, that is to say the internal face of the die 10, has a radius of 21 mm. The distance G between the die 10 and the metal sheet 14 is G=2 mm (see FIG. 1*b*).

The axial impact speed $V_Z$ of the hammer 12 on the elastomer has been measured at 34 m/s. This axial impact speed $V_Z$ is tailored to the geometrical conditions and to the properties of the material constituting the metal sheet 14. The axial impact speed $V_Z$ is calculated so as to allow the plasticization of said metal sheet 14.

It is possible to estimate the radial impact speed $V_R$ (radial striking speed) of the punch 11/metal sheet 14 assembly on the die 10 using the following determination formula:

$$V_R = \frac{V_Z}{2} \cdot \frac{R}{H} \cdot \left(1 + \frac{G}{R}\right)^3 \quad (1)$$

in which $V_R$ denotes the radial speed, $V_Z$ denotes the axial movement speed (imparted by the hammer 12), R/H denotes the aspect ratio of the punch 11, and G/R denotes the ratio of the distance G (between the metal sheet 14 and the die 10) to the radius R of the punch 11. The minimum axial speed $V_{Z_min}$ to be communicated to the hammer 12 is that which makes it possible to obtain a plastic deformation of the metal sheet 14 ("plasticization" of the metal sheet).

The forming device therefore comprises means for controlling this axial speed $V_Z$, as a function of the thickness of the metal sheet 14 to be formed, in such a way that this axial speed $V_Z$ of the hammer is greater than the minimum axial speed $V_{Z_min}$ thus determined.

It should be noted that the radial impact speed $V_R$ is directly proportional to the axial speed $V_Z$, and the preceding remarks therefore likewise apply to the radial speed.

An estimated radial impact speed $V_R$ of 30 m/s is obtained with the numerical data of the present example. The ratio between $V_R$ and $V_Z$ is then 88%.

During the impact of the hammer 12 on the elastomer, the shock generates a dynamic pressure wave whose speed of propagation in the elastomer is significantly greater than the impact speed $V_R$. The metal sheet is then pushed by the radial deformation of the punch toward the internal face of the die 10.

Furthermore, when the metal sheet 14 comes initially into contact with the die 10 under the effect of the deformation of the punch 11, there remain certain zones which are not in contact with the mold (in particular the groove 16). This is in particular the case for the zones where the die 10 has geometries of greater depth (for example decorative etchings or functional geometries). The elastomer punch 11 and the metal sheet 14 continue to deform locally and their deformation speed is likely to be significantly greater than the radial deformation speed $V_R$ during impact.

A plastic deformation of the metal sheet 14 is observed when the pressure generated on impact is greater than the Hugoniot elastic limit. The metal sheet 14 then completely hugs the shape of the die 10, in particular the shape of the groove 16. This plastic deformation of the metal part 14 appears in the case where the radial striking speed $V_R$ verifies the following equation:

$$s.\sigma_{EL} \cdot \frac{1 - v_f}{1 - 2v_f} \cdot \left[\frac{1}{Z_e} + \frac{1}{Z_f}\right] < V_R \quad (2)$$

in which $\sigma_{EL}$ is the elastic limit of the metal sheet 14, $Z_e$ is the acoustic impedance of the die 10, $Z_f$ is the acoustic impedance of the metal sheet 14, $v_f$ is the Poisson's ratio of the metal sheet 14, s is a safety factor greater than or equal to 1 (equaling 1.1 in the present non-limiting exemplary embodiment).

This plastic deformation criterion is translated into a condition about the axial speed $V_Z$ of the hammer 12 at the moment of impact on the punch 11 (by use of the equation 1).

The means for generating a magnetic field are therefore dimensioned to provide the hammer 12 with an axial striking speed $V_Z$ greater than this threshold. The speed $V_Z$ will therefore preferably be between 20 and 200 m/s.

The method of deformation by stamping of a curved metal sheet 14 comprises, in the present non-limiting exemplary embodiment, the following steps:

- placing the metal sheet 14 within the die 10,
- placing the punch 11 inside the metal sheet 14,
- generating a magnetic field imparting to the hammer 12 a speed ($V_Z$) greater than a predetermined value in this direction (Z),
- striking the hammer 12 against the punch 11 along the longitudinal axis (Z),
- radially deforming the punch 11 at a radial impact speed $V_R$ sufficient to obtain a plastic deformation of the metal sheet 14.

Advantages

In other words, the distance G, i.e. the distance between the metal sheet 14 and the die 10, is advantageously chosen to be non-zero to allow the metal sheet 14 to be set in movement at high speed. This high-speed deformation allows more efficient forming and a reduction in elastic return.

Such a device thus has the advantage of considerably reducing the phenomena of elastic return, and makes it possible to form by elastoforming sheet metal parts having a thickness of greater than 1.5 mm, insofar as the speed communicated to the hammer makes it possible to obtain a radial impact speed allowing the metal sheet to be brought within its plastic deformation range.

Variants

The preceding examples have been given by way of illustration and are not exhaustive. It may in particular be possible to carry out the invention by forming a metal sheet 14 having dimensions substantially identical to those of the die 10. The elastomer punch 11 will have, in this case, substantially smaller dimensions in order to maintain a non-zero distance between the punch and the sheet.

The invention claimed is:

1. A device for forming by stamping a curved metal sheet, comprising:

- a punch made of deformable and substantially non-compressible material;
- a hammer configured to strike the punch along a longitudinal axis;
- a generator to generate a magnetic field configured to impart to the hammer an axial speed;

a controller to impart and control the axial speed of the hammer to be greater than or equal to a minimum axial speed for obtaining a plastic deformation of the curved metal sheet;

a die of predetermined shape substantially rotationally symmetrical about the longitudinal axis; and the punch is rotationally symmetrical about the longitudinal axis and configured to face the die such that the punch has a non-zero predetermined distance between the curved metal sheet and the die.

2. The device as claimed in claim 1, wherein the punch has a longitudinal dimension in a same order of magnitude as its radial dimension, perpendicular to the longitudinal axis.

3. The device as claimed in claim 1, wherein the axial speed is greater than 20 m/s.

4. The device as claimed in claim 1, wherein the punch is made of non-compressible elastomer having a Poisson's ratio of 0.5.

5. The device as claimed in claim 1, wherein an end wall of the die forms a stop for a front face of the punch.

6. A method for deforming by stamping of a curved metal sheet, comprising the steps of:

placing the curved metal sheet within a die of a forming device, the die is a predetermined shape substantially rotationally symmetrical about a longitudinal axis;

placing a punch of the forming device inside the metal sheet, the punch is made of deformable and substantially non-compressible material and is rotationally symmetrical about the longitudinal axis;

generating a magnetic field to impart to a hammer of the forming device, an axial speed greater than or equal to a minimum axial speed for obtaining a plastic deformation of the curved metal sheet;

striking the hammer against the punch along the longitudinal axis;

radially deforming the punch at a radial impact speed sufficient to obtain a plastic deformation of the curved metal sheet.

7. The method for deforming by stamping as claimed in claim 6, further comprising the step of positioning the punch to have a non-zero distance between the curved metal sheet and the die.

8. The method of claim for deforming by stamping as claimed in claim 6, wherein the axial speed is greater than or equal to 20 m/s.

9. A device for forming by stamping a curved metal sheet, comprising:

a punch made of deformable and substantially non-compressible material;

a hammer configured to strike the punch along a longitudinal axis;

a generator to generate a magnetic field configured to impart to the hammer an axial speed;

a controller to impart and control the axial speed of the hammer to be greater than or equal to 20 m/s for obtaining a plastic deformation of the curved metal sheet;

a die of predetermined shape substantially rotationally symmetrical about the longitudinal axis; and the punch is rotationally symmetrical about the longitudinal axis and configured to face the die such that the punch has a non-zero predetermined distance between the curved metal sheet and the die.

* * * * *